US009307871B2

(12) United States Patent
McNulty et al.

(10) Patent No.: US 9,307,871 B2
(45) Date of Patent: Apr. 12, 2016

(54) HORIZONTAL PUMPS, REFILL UNITS AND FOAM DISPENSERS

(71) Applicant: GOJO Industries, Inc., Akron, OH (US)

(72) Inventors: John J. McNulty, Broadview Heights, OH (US); Nick E. Ciavarella, Seven Hills, OH (US); Cory J. Tederous, Stow, OH (US); Robert L. Quinlan, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 13/792,115

(22) Filed: Mar. 10, 2013

(65) Prior Publication Data

US 2014/0061246 A1 Mar. 6, 2014

Related U.S. Application Data

(60) Provisional application No. 61/719,618, filed on Oct. 29, 2012, provisional application No. 61/695,140, filed on Aug. 30, 2012.

(51) Int. Cl.
*B65D 88/54* (2006.01)
*A47K 5/14* (2006.01)
(Continued)

(52) U.S. Cl.
CPC ..... *A47K 5/14* (2013.01); *B05B 7/0025* (2013.01); *B05B 11/3015* (2013.01); *B05B 11/3087* (2013.01); *Y10T 29/49236* (2015.01)

(58) Field of Classification Search
CPC .... A47K 5/14; B05B 7/0025; B05B 11/3015; B05B 11/3087
USPC ..... 222/181.1–181.3, 190, 325; 92/152; 417/521, 523, 568, 533
See application file for complete search history.

(56) References Cited

U.S. PATENT DOCUMENTS 2,904,222 A 9/1959 Philippe
3,851,801 A 12/1974 Roth
(Continued)

FOREIGN PATENT DOCUMENTS

CH 676227 A5 12/1990
EP 1147818 A1 10/2001
(Continued)

OTHER PUBLICATIONS

European Patent Office Search Report issued Jan. 7, 2011 in EP Application No. 09 150 880.2; 4 pages.
(Continued)

*Primary Examiner* — Patrick M Buechner
(74) *Attorney, Agent, or Firm* — Calfee, Halter & Griswold LLP

(57) ABSTRACT

Disposable refill units, and pumps for disposable refill units for foam dispensers are disclosed herein. Exemplary embodiments include a container for holding a foamable liquid and a pump secured to the container. The pump includes a liquid chamber formed between a liquid inlet valve and a liquid outlet valve. In addition, the pump includes a sleeve that is located at least partially within the liquid chamber. One or more liquid passages are defined at least in part by an area located between an exterior wall of the sleeve and a wall of the liquid chamber. The pump also includes a piston body having a head and a sealing member located at a first end of the piston. The sealing member forms a seal against the interior wall of the sleeve and the piston head moves within the sleeve to reduce and enlarge the volume of the liquid chamber.

17 Claims, 6 Drawing Sheets

(51) Int. Cl.
*B05B 7/00* (2006.01)
*B05B 11/00* (2006.01)

(56) References Cited

U.S. PATENT DOCUMENTS

| | | | | | |
|---|---|---|---|---|---|
| 4,168,020 | A | | 9/1979 | Benson | |
| 4,330,071 | A | | 5/1982 | Ohlson | |
| 4,360,130 | A | * | 11/1982 | Nishimura et al. | 222/153.09 |
| 4,793,522 | A | | 12/1988 | Corsette | |
| 4,880,161 | A | | 11/1989 | Wright | |
| 4,986,453 | A | | 1/1991 | Lina et al. | |
| 5,100,030 | A | | 3/1992 | Roggenburg et al. | |
| 5,174,476 | A | | 12/1992 | Steiner et al. | |
| 5,209,377 | A | | 5/1993 | Steiner et al. | |
| 5,271,530 | A | | 12/1993 | Uehira et al. | |
| 5,439,140 | A | | 8/1995 | Meyer | |
| 5,439,144 | A | | 8/1995 | Holzner | |
| 5,445,288 | A | | 8/1995 | Banks | |
| 5,462,208 | A | | 10/1995 | Stahley et al. | |
| 5,556,005 | A | * | 9/1996 | Banks | 222/96 |
| 5,605,256 | A | * | 2/1997 | Fan | 222/181.2 |
| 5,799,841 | A | | 9/1998 | Wirt | |
| 5,813,576 | A | | 9/1998 | Iizuka et al. | |
| 5,823,397 | A | * | 10/1998 | Gil | 222/181.3 |
| 5,826,755 | A | | 10/1998 | Burd | |
| 5,862,954 | A | | 1/1999 | Ehrensperger et al. | |
| 5,899,363 | A | | 5/1999 | Bliss, III et al. | |
| 5,906,299 | A | | 5/1999 | Hagleitner | |
| 6,016,936 | A | * | 1/2000 | Fan | 222/181.1 |
| 6,065,647 | A | | 5/2000 | Bliss, III et al. | |
| 6,082,586 | A | | 7/2000 | Banks | |
| 6,283,330 | B1 | | 9/2001 | Gillespie et al. | |
| 6,409,050 | B1 | | 6/2002 | Ophardt et al. | |
| 6,446,840 | B2 | | 9/2002 | Ophardt et al. | |
| 6,626,332 | B2 | | 9/2003 | Ehrensperger et al. | |
| 6,971,549 | B2 | | 12/2005 | Leifheit et al. | |
| 7,059,282 | B2 | | 6/2006 | Vorih et al. | |
| 7,377,758 | B2 | | 5/2008 | Sallows et al. | |
| 7,537,140 | B2 | * | 5/2009 | Lin | 222/321.7 |
| 7,815,076 | B2 | | 10/2010 | Ophardt | |
| 7,819,289 | B2 | | 10/2010 | Willis | |
| 8,047,404 | B2 | | 11/2011 | Quinlan et al. | |
| 8,579,159 | B2 | | 11/2013 | Ciavarella | |
| 8,814,005 | B2 | * | 8/2014 | Banks et al. | 222/190 |
| 2003/0000967 | A1 | * | 1/2003 | Ehrensperger et al. | 222/190 |
| 2004/0031816 | A1 | | 2/2004 | Schuman | |
| 2004/0206772 | A1 | | 10/2004 | Leifheit et al. | |
| 2005/0258192 | A1 | | 11/2005 | Matthews et al. | |
| 2005/0284887 | A1 | * | 12/2005 | Lewis et al. | 222/181.3 |
| 2006/0273114 | A1 | | 12/2006 | Ophardt | |
| 2007/0272709 | A9 | | 11/2007 | Ciavarella et al. | |
| 2008/0237265 | A1 | | 10/2008 | Brouwer | |
| 2008/0237266 | A1 | | 10/2008 | Ciavarella et al. | |
| 2008/0272148 | A1 | | 11/2008 | Malik et al. | |
| 2009/0008408 | A1 | | 1/2009 | Ophardt et al. | |
| 2010/0096412 | A1 | | 4/2010 | Law | |
| 2010/0147894 | A1 | | 6/2010 | Reimann et al. | |
| 2011/0079614 | A1 | | 4/2011 | Ganzeboom et al. | |
| 2012/0217267 | A1 | | 8/2012 | Bunoz et al. | |
| 2013/0315031 | A1 | | 11/2013 | Bunoz et al. | |
| 2014/0124531 | A1 | | 5/2014 | Muderlak et al. | |
| 2014/0217117 | A1 | | 8/2014 | Mirbach | |

FOREIGN PATENT DOCUMENTS

| | | | |
|---|---|---|---|
| EP | 2080464 | A2 | 7/2009 |
| EP | 2080560 | A1 | 7/2009 |
| GB | 1269545 | | 4/1972 |
| GB | 2301812 | | 12/1996 |
| GB | 2472235 | | 2/2011 |
| JP | 2012006601 | A | 1/2012 |
| WO | 2005105320 | A1 | 11/2005 |
| WO | 2008049854 | A1 | 5/2008 |
| WO | 2011012836 | A1 | 2/2011 |
| WO | 2011157975 | A1 | 12/2011 |

OTHER PUBLICATIONS

International Search Report and Written Opinion from International Application No. PCT/US2013/056106, date of mailing Nov. 7, 2013; 10 pages.

International Search Report and Written Opinion from International Application No. PCT/US2013/067158, date of mailing Apr. 11, 2014; 16 pages.

International Search Report and Written Opinion from International Application No. PCT/US2013/067366, date of mailing Apr. 11, 2014; 18 pages.

International Search Report and Written Opinion from International Application No. PCT/US2013/056964, date of mailing Nov. 7, 2013; 12 pages.

International Search Report and Written Opinion from International Application No. PCT/US2013/056549, date of mailing Jan. 15, 2014; 16 pages.

International Search Report and Written Opinion from International Application No. PCT/US2014/012440, date of mailing Jun. 23, 2014.

International Search Report and Written Opinion from International Application No. PCT/US2014/035072, date of mail Jul. 23, 2014.

International Search Report and Written Opinion from International Application No. PCT/US2014/042252, date of mail Sep. 24, 2014.

International Search Report and Written Opinion from International Application No. PCT/US2014/067047, date of mail Feb. 12, 2015.

* cited by examiner

HORIZONTAL PUMPS, REFILL UNITS AND FOAM DISPENSERS

RELATED APPLICATIONS

This non-provisional utility patent application claims priority to and the benefits of U.S. Provisional Patent Application Ser. No. 61/719,618 filed on Oct. 29, 2012, and entitled HORIZONTAL PUMPS, REFILL UNITS AND FOAM DISPENSERS; and U.S. Provisional Patent Application Ser. No. 61/695,140 filed on Aug. 30, 2012, and entitled HORIZONTAL PUMPS, REFILL UNITS AND FOAM DISPENSERS. These applications are incorporated herein by reference in their entirety.

TECHNICAL FIELD

The present invention relates generally to pumps, refill units for foam dispensers and foam dispensers, and more particularly to horizontal foam pumps, refill units and foam dispensers.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. As a general matter, it is usually preferable to reduce the space taken up by the pumping and foaming apparatus within the overall dispenser system. This maximizes the available space for storing the liquid, and has other benefits. In addition, it is desirable to have a foam pump that requires less energy to operate.

SUMMARY

Disposable refill units and pumps for disposable refill units for foam dispensers are disclosed herein. Exemplary embodiments of refill units include a container for holding a foamable liquid and a pump secured to the container. The pump includes a liquid chamber formed between a liquid inlet valve and a liquid outlet valve. In addition, the pump includes a sleeve that is located at least partially within the liquid chamber. One or more liquid passages are defined at least in part by an area located between an exterior wall of the sleeve and a wall of the liquid chamber. The pump also includes a piston body having a head and a sealing member located at a first end of the piston. The sealing member forms a seal against the interior wall of the sleeve and the piston head moves within the sleeve to reduce and expand the volume of the liquid chamber.

Another exemplary embodiment of a refill unit for a foam dispenser includes a container for holding foamable liquid and a pump housing connected to the container. The pump housing includes a liquid pump portion that has a liquid chamber. The liquid chamber has a liquid inlet and a liquid outlet. The pump includes an annular housing having a first portion and a second portion, wherein the first portion has a diameter that is greater than the diameter of the second portion. In addition, the pump includes a piston having a liquid piston head and an air piston head. The air piston head is configured to form seal with the first portion of the annular housing and the liquid piston head is configured to form a seal with the second portion of the annular housing. Movement of the piston in a reciprocating fashion moves liquid and air. At least a part of the second portion of the annular housing fits within the liquid chamber of the pump housing and forms one or more liquid passages between the liquid chamber and an outside wall of the second portion of the annular housing.

Another exemplary embodiment of a refill unit for a foam dispenser includes a refill unit that includes a container for foamable liquid and a pump housing connected to the container. The pump housing includes a liquid chamber. The liquid chamber has a liquid inlet and a liquid outlet. A sleeve is located at least partially within the liquid chamber. The pump includes a piston configured to move reciprocally within the sleeve to increase and decrease the volume of the liquid chamber. One or more liquid passages are formed between an outside wall of the sleeve and a wall of the liquid chamber. Liquid that enters the liquid chamber through the liquid inlet and liquid that exits the liquid chamber through the liquid outlet flows through the one or more liquid passages.

BRIEF DESCRIPTION OF THE DRAWINGS

These and other features and advantages of the present invention will become better understood with regard to the following description and accompanying drawings in which.

DETAILED DESCRIPTION

Figure 1:
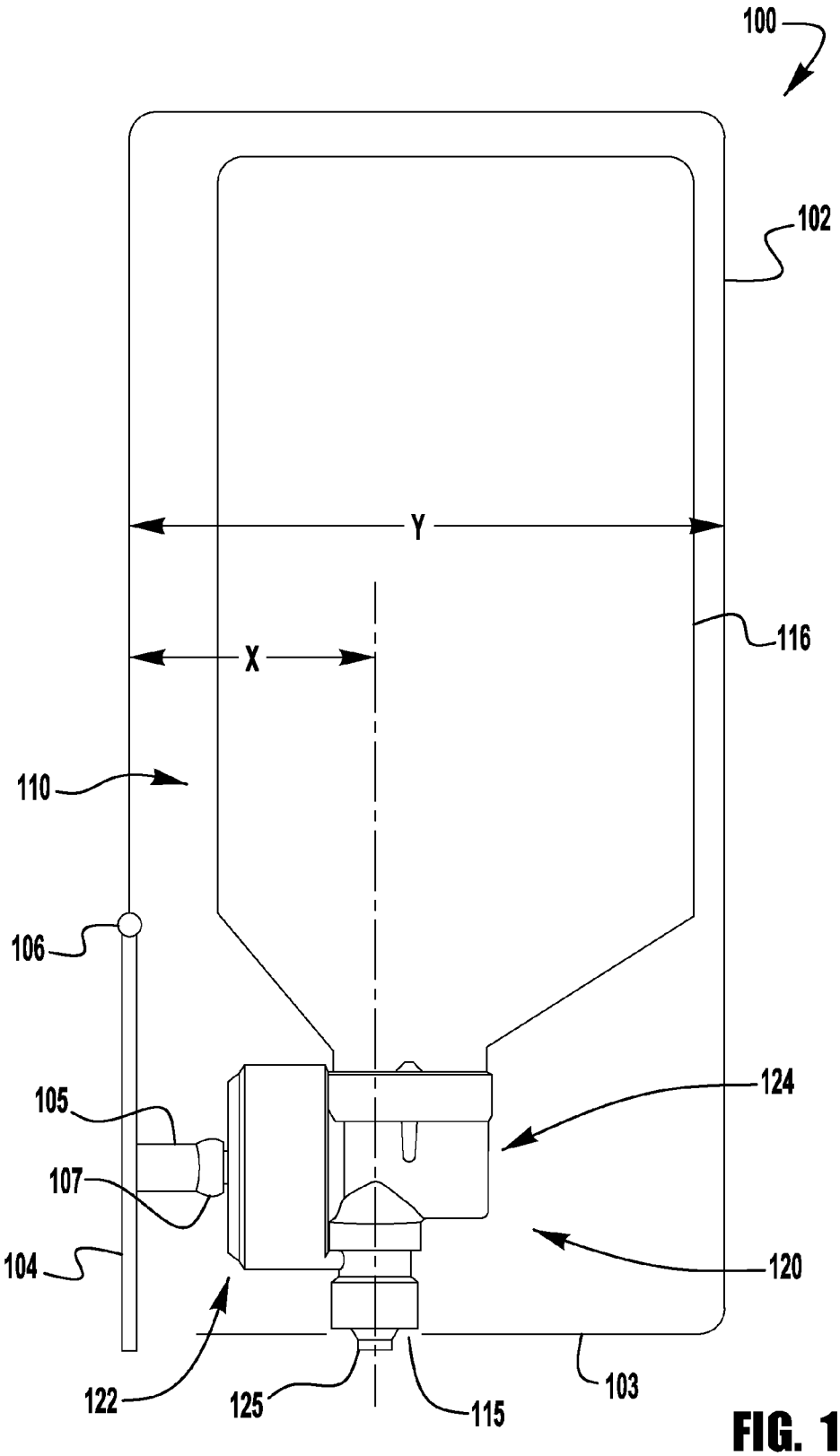
FIG. 1 is a cross-section of an exemplary foam dispenser 100 having a refill unit 110.

FIG. 1 illustrates an exemplary embodiment of a foam dispenser 100. The cross-section of FIG. 1 is taken through the housing 102 to show the foam pump 120 and container 116. Foam dispenser 100 includes a disposable refill unit 110. The disposable refill unit 110 includes a container 116 connected to a foam pump 120. The foam dispenser 100 may be a wall-mounted system, a counter-mounted system, an unmounted portable system movable from place to place or any other kind of foam dispenser system.

The container 116 forms a liquid reservoir that contains a supply of a foamable liquid within the disposable refill unit 110. In various embodiments, the contained liquid could be for example a soap, a sanitizer, a cleanser, a disinfectant or some other foamable liquid. In the exemplary disposable refill unit 110, the container 116 is a collapsible container and can be made of thin plastic or a flexible bag-like material. In other embodiments, the container 116 may be formed by a rigid housing member, or have any other suitable configuration for containing the foamable liquid without leaking. The container 116 may advantageously be refillable, replaceable or both refillable and replaceable. In other embodiments, the container 116 may be neither refillable nor replaceable.

In the event the liquid stored in the container 116 of the installed disposable refill unit 110 runs out, or the installed refill unit 110 otherwise has a failure, the installed refill unit 110 may be removed from the foam dispenser 100. The empty or failed disposable refill unit 110 may then be replaced with a new disposable refill unit 110.

The housing 102 of the foam dispenser 100 contains one or more actuating members 104 to activate the pump 120. As used herein, actuator or actuating members or mechanism includes one or more parts that cause the dispenser 100 to move liquid, air or foam. Actuator 104 is generically illustrated because there are many different kinds of pump actuators which may be employed in the foam dispenser 100. The actuator of the foam dispenser 100 may be any type of actuator such as, for example, a manual lever, a manual pull bar, a manual push bar, a manual rotatable crank, an electrically activated actuator or other means for actuating the foam pump 120 which includes a liquid pump portion 124 and air compressor portion 122. Electronic actuators may additionally include a sensor to provide for a hands-free dispenser system with touchless operation. In one embodiment, actuator 104 is connected to housing 102 by a hinge member 106. Various intermediate linkages, such as for example linkage 105, connect the actuator member 104 to the foam pump 120 within the system housing 102. In one embodiment, linkage 105 has a socket 107 that snaps onto a ball 241 (FIG. 2) at the proximate end of piston 240. An aperture 115 in bottom plate 103 of housing 102 allows foam dispensed from the nozzle 125 of foam pump 120 to be dispensed to a user.

As described in more detail below, one advantage of the exemplary embodiments of the present invention is that the outlet of the foam pump 120 may be offset from the liquid inlet. Thus, a more compact housing 102 may be used. In one embodiment the distance X from the front of the housing 102 to the centerline of the outlet nozzle 125 is between about 1.25 and 2.5 inches. In one embodiment, the distance X is between about 1.5 and 2 inches, and in one embodiment the distance is about 1.7 inches from the front of the housing. In one embodiment, the overall depth Y of housing 102 is less than about 5 inches, and in another embodiment the overall depth Y is about 4 inches.

Figure 2:
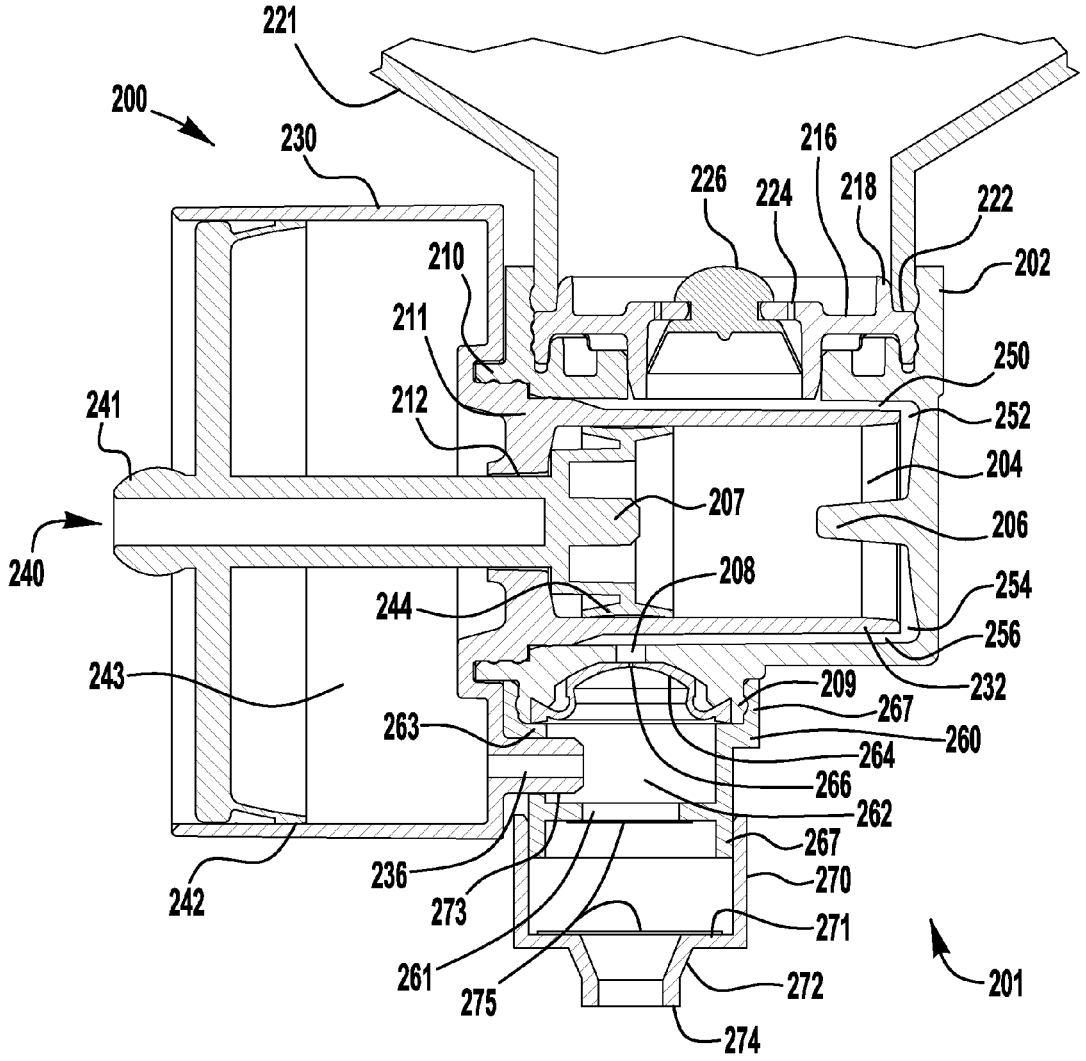
FIG. 2 is a cross-section of an exemplary refill unit 200.

FIG. 2 is a cross-sectional view of an exemplary embodiment of a refill unit 200 suitable for use in foam dispensers. Refill unit 200 includes a container 221 for holding a foamable liquid connected to a foam pump 201. Liquid pump 201 includes a housing 202. Housing 202 receives inlet plate 216. Inlet plate 216 includes an annular projection 218. A neck of a container 221 is received within an annular groove 222 formed between annular projection 218 and housing 202. Housing 202 may be connected to the container 221 by any means such as, for example, a threaded connection, a welded connection, an adhesive connection or the like. Optionally, a gasket may fit in annular groove 222 to help form a liquid tight seal with the container 221. Inlet plate 216 may be integrally formed with housing 202.

Inlet plate 216 includes one or more inlet apertures 224 located therethrough. In addition, one-way inlet valve 226 is secured to inlet plate 216. One-way inlet valve 226 may be any type of one-way valve such as, for example, a ball and spring valve, a poppet valve, a flapper valve, an umbrella valve, a slit valve, a mushroom valve, a duck bill valve or the like.

Pump housing 202 includes a liquid chamber 204. In one embodiment liquid chamber 204 is cylindrical. Located at least partially within liquid chamber 204 is a sleeve 232. Housing 202 includes an annular projection 210 at one end of the liquid chamber 204. Sleeve 232 is secured to annular projecting member 210 by collar 211. Collar 211 includes an aperture 212.

A piston 240 includes a shaft 241 that projects through aperture 212. Piston 240 is slideable in a reciprocating manner within sleeve 232. Piston 240 includes a piston head having a double wiper seal 244 located at the distal end. Movement of piston 240 causes the volume of liquid chamber 204 to expand and contract. Double wiper seal 244 may be any type of sealing member such as, for example, an o-ring, a single wiper seal or the like. Housing 202 includes a projecting member 206 that contacts an end 207 of piston 240 to stop movement of piston 240 when it reaches the end of its stroke.

In addition, piston 240 includes a second piston head and sealing member 242 located at the proximal end of piston 240. Second sealing member 242 engages the inside of the air compressor housing 230. The term "air compressor" may be used interchangeably herein with the term "air pump." In one embodiment, air compressor housing 230 and sleeve 232 are formed as one piece. Movement of piston 240 causes air chamber 243 to expand and contract. Air chamber 243 includes an air outlet 236, which is also an air inlet to mixing chamber 262. In one embodiment, air outlet 236 is integrally formed with both sleeve 232 and air compressor housing 230.

A liquid inlet passageway 250 is formed between sleeve 232 and the wall of liquid chamber 204. The liquid inlet passageway 250 may extend entirely around sleeve 232 or may be enclosed by one or more rib projections (not shown) that cause liquid in inlet passageway 250 to flow through passage 250 and passage 252 into the interior of sleeve 232. Outlet passages 254, 256 also exist between sleeve 232 and the walls of liquid chamber 204. Outlet passageway 256 may extend entirely around sleeve 232 or may be enclosed by one or more rib projections (not shown) that cause liquid to flow from the interior of sleeve 232 through passageways 254, 256. Passageway 254 and passageway 250 may be connected to form a common passageway.

Housing 202 includes an outlet passage 208. Connected to housing 202 is lower housing 260. Lower housing 260 may be connected to housing 202 by any means such as, for example, a threaded connection, a snap-fit connection, a welded connection an adhesive connection or the like. In the present exemplary embodiment, lower housing 260 includes annular projection 267 that snaps onto annular projection 209 of housing 202. Located proximate outlet passage 208 is a liquid outlet valve 264. Liquid outlet valve 264 includes a slit 266. Slit 266 opens to allow liquid to flow from liquid chamber 204 into mixing chamber 262. The backing provided by the wall surrounding the liquid outlet 208 prevents the slit 266 from opening when there is pressure in mixing chamber 262 and prevents liquid and/or air from entering liquid chamber 204 from mixing chamber 262. Liquid outlet valve 264 is retained in place by annular rim 263 on lower housing member 260. While a slit valve is shown and advantageously takes up very little room, other types of liquid outlet valves may be used such as, for example, a ball and spring valve, a flapper valve, a poppet valve, a mushroom valve, a duck-bill valve or the like.

Lower housing 260 has an interior cavity that forms a mixing chamber 262. Lower housing 260 includes an opening 273 in the wall of mixing chamber 262. The air outlet 236 of air chamber 243 is fitted into opening 273 to allow mixing chamber 262 to be in fluid communication with air chamber 243. Mixing chamber 262 is in fluid communication with liquid chamber 204 through valve 264. In addition, lower housing 260 includes an outlet opening 261 and a lower annular projection 267. Outlet nozzle 270 fits over lower projection 267 to secure outlet nozzle 270 to lower housing 260. Outlet nozzle 270 is secured using a press-fit connection, but may be connected by other means such as, for example, a snap-fit connection, an adhesive, a threaded connection or the like. Outlet nozzle 270 includes a floor 271, a tapered portion 272 and an outlet 274. In addition, a foaming media 275, such as one or more screens, is included in outlet nozzle 270. Optionally, a foaming cartridge may be used whereby the foaming cartridge rests on floor 271. In some embodiments, screens 275 are replaced by one or more porous members or baffles.

An exemplary benefit to using sleeve 232 is that the liquid inlets 224, or liquid inlet valve 226 may be positioned over any portion of the sleeve 232 without affecting the volume of liquid chamber 204 or reducing the efficiency of pump 201. Similarly, the liquid outlet 208 and/or liquid outlet valve 264 may be located along any portion of the sleeve 232 without reducing the volume of liquid chamber 204 or reducing the efficiency of pump 201. In some embodiments, the liquid inlet and the liquid outlet are off-set from one another. In some embodiments the liquid outlet is located closer to the front of a dispenser than the liquid inlet when the pump 201 is installed in the foam dispenser. In some embodiments, the liquid inlet and liquid outlet are along a common axis. The piston 240 may move along a pump axis that is substantially horizontal. In some embodiments, the liquid inlet valve 226 moves along an axis that is substantially normal to the pump axis. In some embodiments, at least a portion of the liquid inlet valve 226 moves along a substantially vertical axis even though it may collapse both horizontally and vertically.

In addition, although the pump 201 has been described as being made of selected sub-parts, pump 201, as well as the other embodiments of pumps disclosed herein, may be made from more sub-parts or fewer sub-parts.

During operation, as piston 240 of pump 201 moves from a discharged position to a charged position or primed state, liquid flows in through liquid inlets 224, past one-way inlet valve 226, into liquid chamber 204, through passages 250, 252 and into the interior of sleeve 232, which also forms a portion of the liquid chamber 204.

Movement of piston 240 from the charged position to the discharged position causes fluid to flow out of the liquid chamber 204 (including the center of the sleeve 232) through passages 254, 256, past liquid outlet valve 264 and into mixing chamber 262. Simultaneously, the volume of air chamber 243 is reduced and air flows out of air outlet 236 into mixing chamber 262. The air and liquid mixture is forced through opening 261 and through foam media 275 to create a rich foam. The rich foam travels through tapered section 272 where it accelerates due to the reduced volume and exits foam pump 201 through outlet 274.

Figure 3:
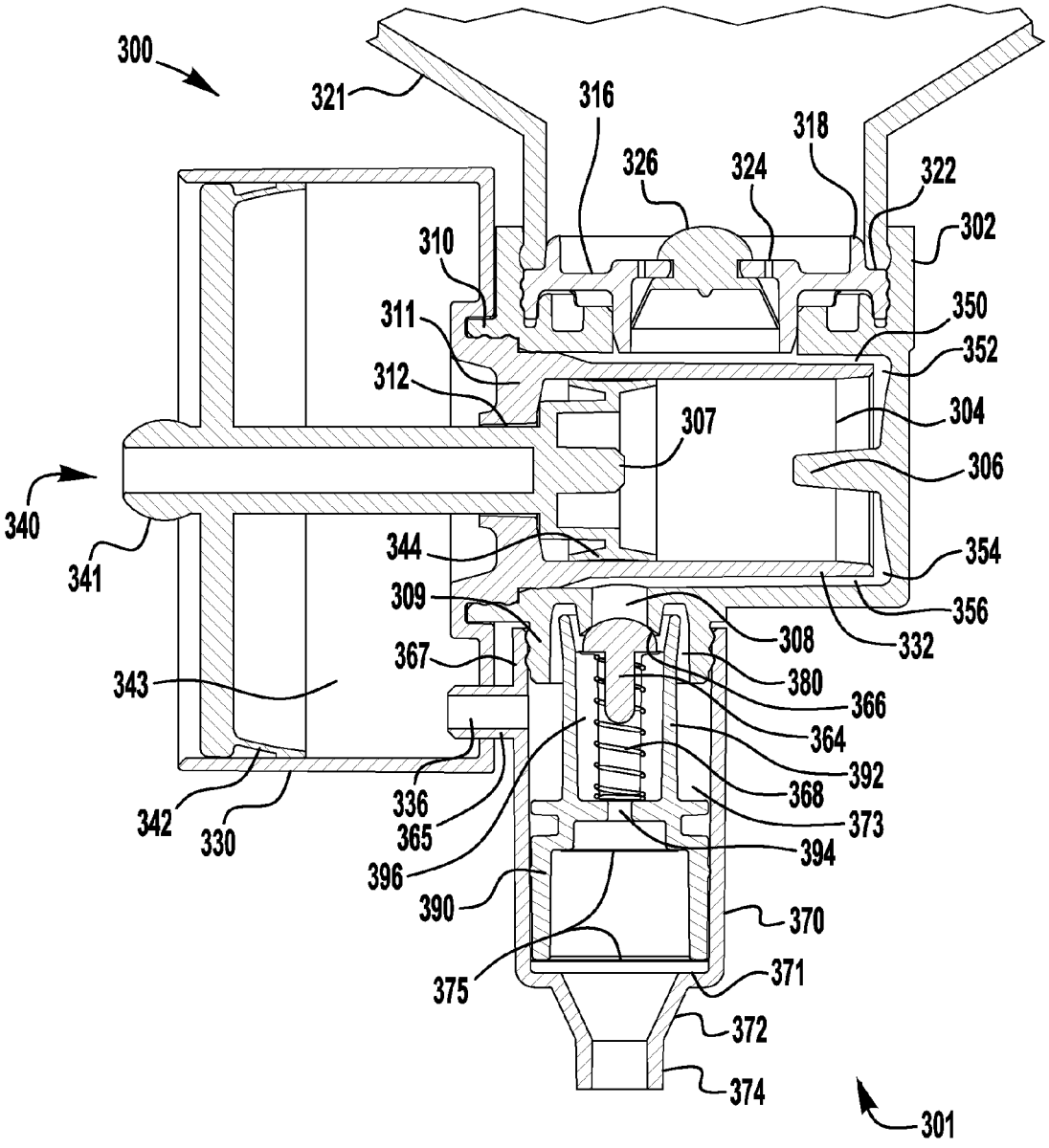
FIG. 3 is a cross-section of another exemplary refill unit 300.

FIG. 3 is a cross-sectional view of another exemplary embodiment of a refill unit 300 suitable for use in foam dispensers. Refill unit 300 includes a container 321 for holding a foamable liquid connected to a foam pump 301. Foam pump 301 includes a housing 302. Housing 302 receives inlet plate 316. Inlet plate 316 includes a annular projection 318. A neck of a container 321 is received within an annular groove 322 formed between annular projection 318 and housing 302. Housing 302 may be connected to the container 321 by any means such as, for example, a threaded connection, a welded connection, an adhesive connection or the like. Optionally a gasket may fit in annular groove 322 to help form a liquid tight seal with the container. Inlet plate 316 may be integrally formed with housing 302. Inlet plate 316 includes one or more inlet apertures 324 located therethrough. In addition one-way inlet valve 326 is secured to inlet plate 316. One-way inlet valve 326 may be any type of one-way valve such as, for example, a ball and spring, a poppet valve, a flapper valve, an umbrella valve, a slit valve, a mushroom valve, a duck-bill valve or the like.

Pump housing 302 includes a liquid chamber 304. In one embodiment liquid chamber 304 is cylindrical. Located at least partially within liquid chamber 304 is a sleeve 332. Housing 302 includes an annular projection 310 at one end of the liquid chamber 304. Sleeve 332 is secured to annular projecting member 310 by collar 311. Collar 311 includes an aperture 312.

A piston 340 includes a shaft 341 that projects through aperture 312. Piston 340 is slideable in a reciprocating manner within sleeve 332. Piston 340 includes a piston head having a double wiper seal 344 located at the distal end. Movement of piston 340 causes the volume of liquid chamber 304 to expand and contract. Double wiper seal 344 may be any type of sealing member such as, for example, an o-ring, a single wiper seal or the like. Housing 302 includes a projecting member 306 that contacts an end 307 of piston 340 to stop movement of piston 340 when it reaches the end of its stroke.

In addition, piston 340 includes a second piston head and sealing member 342 located at the proximal end. Second sealing member 342 engages the inside of the air compressor housing 330. The term "air compressor" may be used interchangeably herein with the term "air pump." In one embodiment, air compressor housing 330 and sleeve 332 are formed as one piece. Movement of piston head 342 expands and contracts air chamber 343. Air chamber 343 includes an air outlet 336, which is also an air inlet to mixing chamber 396. In one embodiment, air outlet 336 is integrally formed with both sleeve 332 and air compressor housing 330.

A liquid inlet passageway 350 is formed between sleeve 332 and the wall of liquid chamber 304. The inlet passageway 350 may extend entirely around sleeve 332 or may be enclosed by one or more rib projections (not shown) that cause liquid in inlet passageway 350 to flow through passage 350 and passage 352 into the interior of sleeve 332. Outlet passages 354, 356 also exist between sleeve 332 and liquid chamber 304. Outlet passageway 356 may extend entirely around sleeve 332 or may be enclosed by one or more rib projections (not shown) that cause liquid to flow through passageways 354, 356 from the interior of sleeve 332. Passageway 354 and passageway 350 may be connected to form a common passageway.

Housing 302 includes a liquid outlet opening 308 and valve seat 366. Connected to housing 302 is lower housing 370. Housing 302 includes projecting member 309 that engages with projecting member 367 of lower housing 370 to form a snap-fit connection. Optionally, lower housing 370 may be connected to housing 302 by any means such as, for example, a threaded connection, a press-fit connection, a welded connection, an adhesive connection or the like. Lower housing 370 has an interior cavity 373. Lower housing 370 also includes a first annular projection 365 that forms an air inlet 336. In addition, lower housing 370 includes a floor 371. A tapered section 372 extends from floor 371 to annular outlet 374.

Located within cavity 373 is an insert 390. Insert 390 may be made of one or more components. Insert 390 includes an interior cavity 396 formed by annular member 392. Interior cavity 396 retains one-way outlet valve 364 and biasing member 368. Interior cavity 396 is also the mixing chamber. One-way outlet valve 364 seals against valve seat 366. One-way outlet valve 364 may be any type of one-way valve such as, for example, a ball and spring valve, a poppet valve, a flap valve, an umbrella valve, a slit valve or the like.

Insert 390 includes an opening 394 to allow liquid and air to flow down and through foaming media 375 secured therein. Foaming media 375 may be one or more screens, porous members, baffles, sponges, foaming cartridges, a combination thereof or the like. Foaming media 375 may be an integral part of insert 390 or may be a separate part.

In addition, although the pump 301 has been described as being made of selected sub-parts, pump 301, as well as the other embodiments of pumps disclosed herein, may be made from more sub-parts or fewer sub-parts.

During operation, as piston 340 of pump 301 moves from a discharged position to a charged position or primed state, liquid flows in through liquid inlets 324, past one-way inlet valve 326 into liquid chamber 304 and through passages 350, 352 and into the interior of sleeve 332 (which also forms a portion of the liquid chamber 304).

Movement of piston 340 from the charged position to the discharged position causes fluid to flow out of the liquid chamber 304 (including the center of the sleeve 332 through passages 354, 356 past liquid outlet valve 364 into mixing chamber 396. Simultaneously, the volume of air chamber 343 is reduced and air flows out of air outlet 336 into cavity 373, up around annular projection 392 and mixes with the liquid in mixing chamber 396. The air and liquid mixture is forced through opening 394 and through foam media 375 to create a rich foam. The rich foam travels through tapered section 372 where it accelerates due to the reduced volume and exits foam pump 301 through outlet 374.

Figure 5:
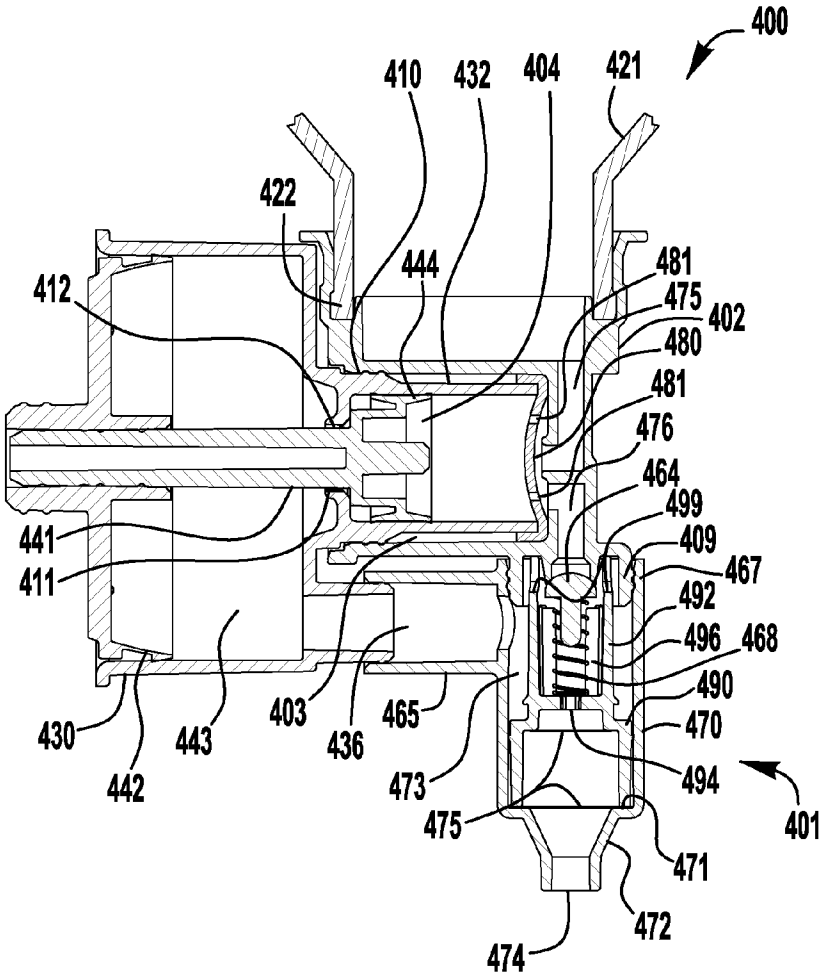
FIGS. 4 and 5 are cross-sections of another exemplary refill unit 400.
Figure 4:
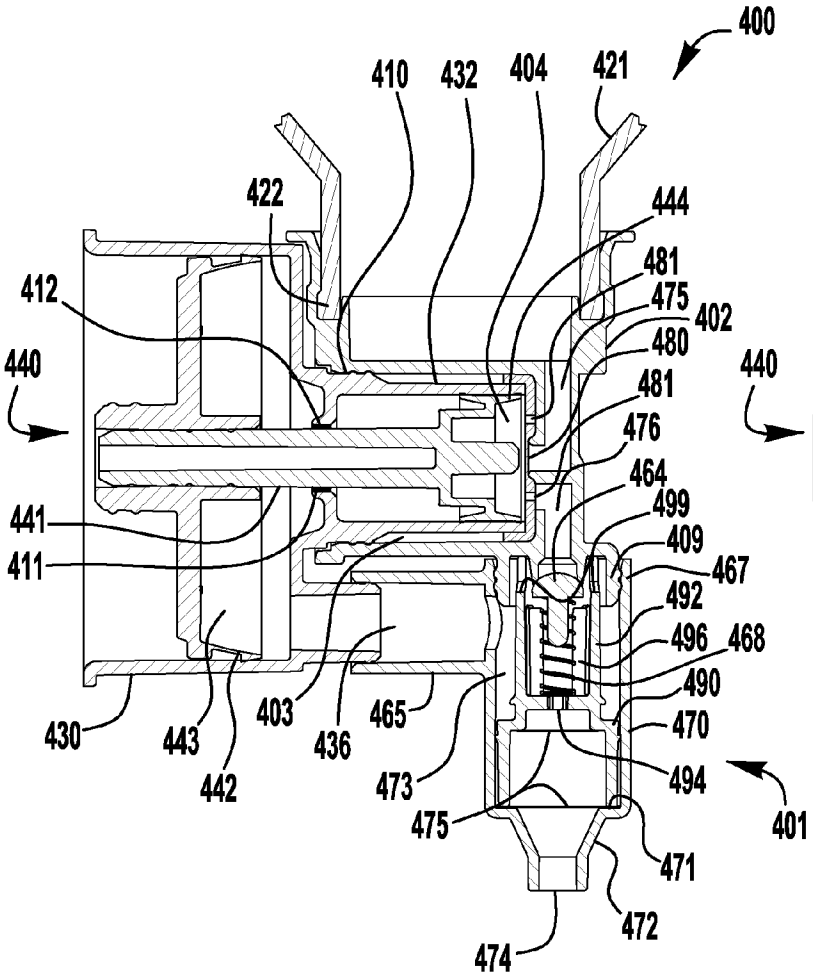

FIGS. 4 and 5 illustrate cross-sectional views of another exemplary embodiment of a refill unit 400 suitable for use in foam dispensers. Refill unit 400 includes a container 421 for holding a foamable liquid connected to a foam pump 401. Foam pump 401 includes a housing 402. Housing 402 may be connected to the container 421 by any means such as, for example, a threaded connection, a welded connection, an adhesive connection or the like. Optionally, a gasket may fit in annular groove 422 to help form a liquid-tight seal with the container.

Housing 402 includes a cavity 403, a liquid inlet passage 475 and a liquid outlet passage 476. Liquid inlet passage 475 places container 421 in fluid communication with cavity 403. Liquid outlet passage 476 places the cavity 403 in fluid communication with a mixing chamber 496.

Located at least partially within cavity 403 is a sleeve 432. Housing 402 includes an annular projection 410 at one end of the cavity 403. Sleeve 432 is secured to annular projecting member 410 by collar 411. Collar 411 includes an aperture 412.

A piston 440 includes a shaft 441 that projects through aperture 412. Piston 440 is slideable in a reciprocating manner within sleeve 432. Piston 440 includes a piston head having a double wiper seal 444 located at the distal end. Movement of piston 440 causes the volume of liquid chamber 404 to expand and contract. Double wiper seal 444 may be any type of sealing member such as, for example, an o-ring, a single wiper seal or the like.

In addition, piston 440 includes a second piston head and sealing member 442 located at the proximal end. Second sealing member 442 engages the inside of the air compressor housing 430. The term "air compressor" may be used interchangeably herein with the term "air pump." In one embodiment, air compressor housing 430 and sleeve 432 are formed as one piece. Movement of piston head 442 expands and contracts air chamber 443. Air chamber 443 includes an air outlet 436, which is also an air inlet to mixing chamber 496.

A flexible membrane 480 is located within cavity 403 and is secured in place by cylindrical sleeve 432. Flexible membrane 480 includes one or more apertures 481 therethrough. In some embodiments, one or more of the apertures align with an opening into liquid outlet passage 476. The flexible membrane 480 is a one-way liquid inlet valve. The flexible membrane 480 covers liquid inlet passage 475 and prevents liquid from flowing out of the liquid pump chamber 404, that is formed at least partially within cylindrical sleeve 432, back up through liquid inlet passage 475. When piston 440 is moved inward it creates pressure in liquid pump chamber 404, the liquid flows out of liquid pump chamber 404 through one or more apertures 481 and into liquid outlet passage 476. When piston 440 is moved outward, a vacuum is created in liquid pump chamber 404. The vacuum pressure causes flexible membrane 480 to flex inward and uncover liquid inlet passage 475. Liquid flows through the liquid inlet passage 475 and into the liquid pump chamber 404.

Connected to housing 402 is lower housing 470. Housing 402 includes projecting member 409 that engages with projecting member 467 of lower housing 470 to form a snap-fit connection. Optionally, lower housing 470 may be connected to housing 402 by any means such as, for example, a threaded connection, a press-fit connection, a welded connection, an adhesive connection or the like. Lower housing 470 has an interior cavity 473. Lower housing 470 also includes a first annular projection 465 that forms an air inlet 436. In addition, lower housing 470 includes a floor 471. A tapered section 472 extends from floor 471 to annular outlet 474.

Located within cavity 473 is an insert 490. Insert 490 may be made of one or more components. Insert 490 includes an interior cavity 496 formed by annular member 492. Interior cavity 496 retains one-way outlet valve 464 and biasing member 468. Interior cavity 496 is also the mixing chamber. One-way outlet valve 464 seals against valve seat formed by housing 402. One-way outlet valve 464 may be any type of one-way valve such as, for example, a ball and spring valve, a poppet valve, a flap valve, an umbrella valve, a slit valve or the like.

Insert 490 includes an opening 494 to allow liquid and air to flow down and through foaming media 475 secured therein. Foaming media 475 may be one or more screens, porous members, baffles, sponges, foaming cartridges, a combination thereof or the like. Foaming media 475 may be an integral part of insert 490 or may be a separate part.

In addition, although the pump 401 has been described as being made of selected sub-parts, pump 401, as well as the other embodiments of pumps disclosed herein, may be made from more sub-parts or fewer sub-parts.

During operation, as piston 440 of pump 401 moves from a discharged position to a charged position or primed state, liquid flows in through liquid inlet passage 475, through apertures 481 in flexible membrane 480, as described above, and into liquid pump chamber 404.

Movement of piston 440 from the charged position to the discharged position causes fluid to flow out of the liquid pump chamber 404 through one or more apertures 481 in flexible membrane 480, past liquid outlet valve 464 into mixing chamber 496. Simultaneously, the volume of air chamber 443 is reduced and air flows out of air outlet 436 into cavity 473, up through apertures 499 and mixes with the liquid in mixing chamber 496. The air and liquid mixture is forced through opening 494 and through foam media 475 to create a rich foam. The rich foam travels through tapered section 472 where it accelerates due to the reduced volume and exits foam pump 401 through outlet 474.

Figures 6, 7:
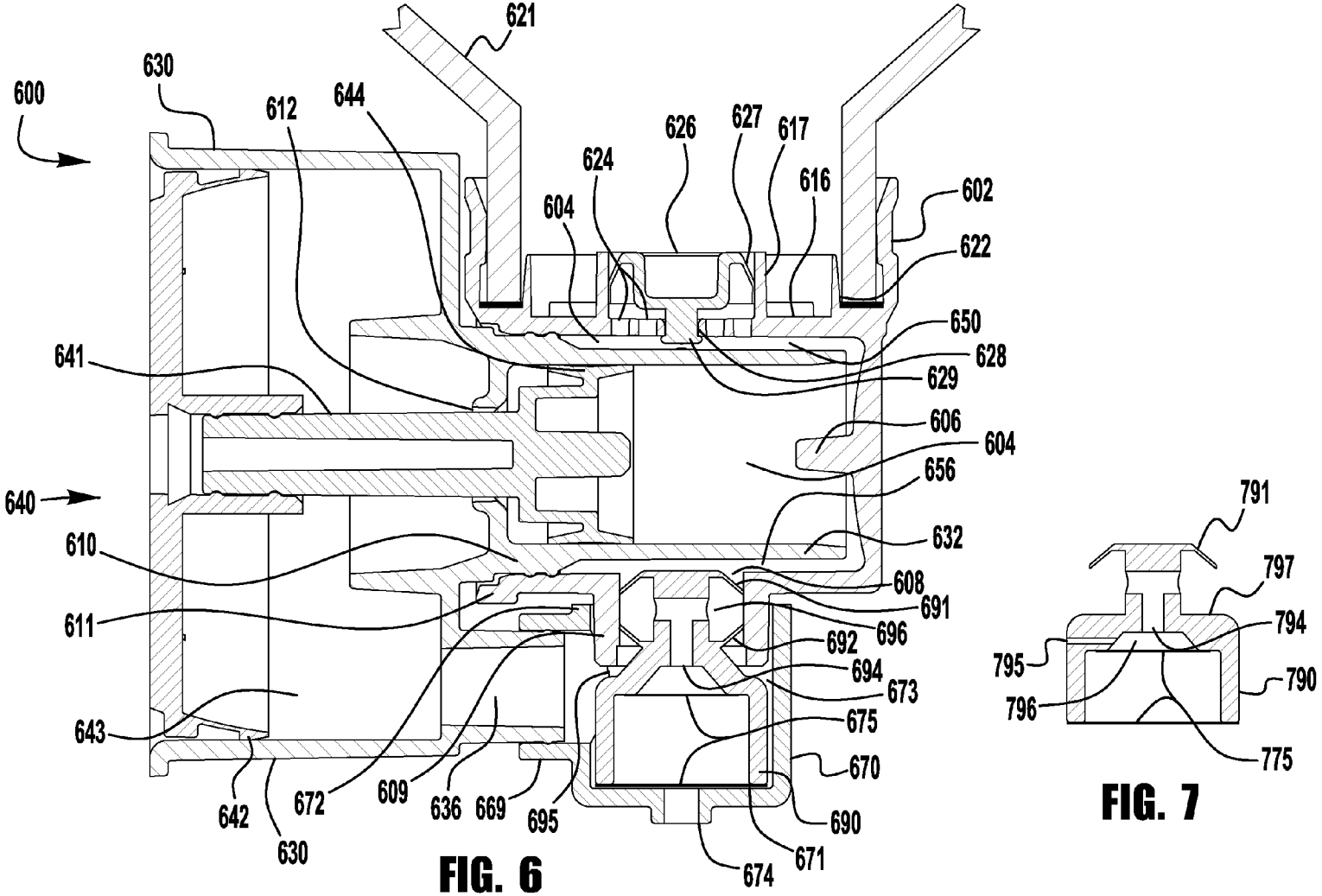
FIG. 6 is a cross-section of another exemplary refill unit 600.
FIG. 7 is a cross-section of an insert for use in the exemplary pump of refill unit 600.

FIG. 6 illustrate a cross-sectional view of another exemplary embodiment of a refill unit 600 suitable for use in foam dispensers. Refill unit 600 includes a container 621 for holding a foamable liquid connected to a foam pump 601. Foam pump 601 includes a housing 602. Housing 602 may be connected to the container 621 by any means such as, for example, a threaded connection, a welded connection, an adhesive connection or the like. Optionally, a gasket 622 may fit in an annular groove to help form a liquid-tight seal with the container 621.

Housing 602 includes a top plate 616. Top plate 616 includes an annular inlet valve projection 617. Located within annular inlet valve projection 617 are a plurality of liquid inlet apertures 624 and an inlet valve retention aperture 628. An inlet valve has a seal 627 that engages annular projection 617 to form a one-way inlet valve. Inlet valve 626 includes a stem 629 that extends through inlet valve retention aperture 628. Stem 629 includes an expanded base or bulb at the distal end that is squeezed through inlet valve retention aperture 628 and expands once it is within cavity 603 to anchor one-way inlet valve 626 in place.

Pump housing 602 includes a liquid chamber 604. In some embodiments liquid chamber 604 is cylindrical, and in some embodiments liquid chamber 604 is partially cylindrical. Located at least partially within liquid chamber 604 is a sleeve 632. Housing 602 includes an annular projection 610 at one end of the liquid chamber 604. Sleeve 632 is secured to annular projecting member 610 by collar 611 located on sleeve 632. Sleeve 632 may be connected to housing 602 by any means, such as for example, an adhesive, a weld, a press-fit connection or the like. Collar 611 includes an aperture 612.

A piston 640 includes a shaft 641 that projects through aperture 612. Piston 640 is slideable in a reciprocating manner within sleeve 632. Piston 640 includes a piston head having a double wiper seal 644 located at the distal end. Movement of piston 640 causes the volume of liquid chamber 604 to expand and contract. Double wiper seal 644 may be any type of sealing member such as, for example, an o-ring, a single wiper seal or the like. Housing 602 includes a projecting member 606 that contacts an end 607 of piston 640 to stop movement of piston 640 when it reaches the end of its stroke. In some embodiments, piston 640 is movable in a direction that is normal to the fluid output of pump 601.

In addition, piston 640 includes a second piston head and sealing member 642 located at the proximal end. Second sealing member 642 engages the inside of the air compressor housing 630. The term "air compressor" may be used interchangeably herein with the term "air pump." In one embodiment, air compressor housing 630 and sleeve 632 are formed as one piece. Movement of piston head 642 expands and contracts air chamber 643. Air chamber 643 includes an air outlet 636, which is also an air inlet to mixing chamber 696. In one embodiment, air outlet 636 is integrally formed with both sleeve 632 and air compressor housing 630. In some embodiments, a one-way air inlet valve (not shown) is used to allow air to enter air chamber 636 to recharge the air chamber 636.

A liquid inlet passageway 650 is formed between sleeve 632 and the wall of liquid chamber 604. The inlet passageway 650 may extend entirely around sleeve 632 or may be enclosed by one or more rib projections (not shown) that cause liquid in inlet passageway 650 to flow through passage 650 and passage 652 into the interior of sleeve 632. Outlet passages 654, 656 also exist between sleeve 632 and liquid chamber 604. Outlet passageway 656 may extend entirely around sleeve 632 or may be enclosed by one or more rib projections (not shown) that cause liquid to flow through passageways 654, 656 from the interior of sleeve 632. In some embodiments, passageway 654 and passageway 650 may be connected to form a common passageway.

Housing 602 includes a liquid outlet opening 608 formed at least partially in annular projection member 609. Connected to housing 602 is lower housing 670 which engages with projecting member 672 to form a snap-fit connection. Optionally, lower housing 670 may be connected to housing 602 by any means such as, for example, a threaded connection, a press-fit connection, a welded connection, an adhesive connection or the like. Lower housing 670 has an interior cavity 673. Lower housing 670 also includes a first annular projection 669 that forms part of air inlet 636 and is secured thereto. In addition, lower housing 670 includes a floor 671 and an outlet 674.

Located within cavity 673 is an insert 690. Insert 690 may be made of one or more components. Insert 690 includes a liquid inlet seal 691, an air inlet seal 692 and a cavity that contains foaming media 675. Foaming media 675 may be one or more screens, porous members, baffles, sponges, foaming cartridges, a combination thereof or the like. Foaming media 675 may be an integral part of insert 690 or may be a separate part. In addition, insert 690 contains a passage 694 therethrough that extends from mixing chamber 696 to the cavity that holds foaming media 675. An air passage 671 leads from air inlet passage 636 to air inlet wiper valve 692. In one embodiment, liquid inlet valve 691 and air inlet valve 692 require between about 2 and 5 psi to open.

In addition, although the pump 601 has been described as being made of selected sub-parts, pump 601, as well as the other embodiments of pumps disclosed herein, may be made from more sub-parts or fewer sub-parts.

During operation, as piston 640 of pump 601 moves from a discharged position to a charged position or primed state, liquid flows in through liquid inlets 624, past one-way inlet valve 626 into liquid chamber 604 and through passages 650, 652 and into the interior of sleeve 632 (which also forms a portion of the liquid chamber 604).

Movement of piston 640 from the charged position to the discharged position causes fluid to flow out of the liquid chamber 604 (including the center of the sleeve 632) through passages 654, 656 past liquid outlet valve 691 into mixing chamber 696. Simultaneously, the volume of air chamber 643 is reduced and air flows out of air outlet 636 past air inlet valve 692 and mixes with the liquid in mixing chamber 696. The air and liquid mixture is forced through passageway 694 and through foam media 675, which creates a rich foam. The rich foam exits foam pump 601 through outlet 674.

FIG. 7 illustrates another exemplary embodiment of an insert 790 that may be used to replace insert 690 in pump 601. Insert 790 may be made of one or more components. Insert 790 includes a liquid inlet seal 791. Insert 790 includes a top seat 797 that contacts the bottom of annular projection 609 and forms a seal. An air inlet 795 extends from air passage 636 into mixing chamber 796. A cavity in insert 790 contains foaming media 775. In addition, insert 790 contains a passage 794 that extends from the downstream side of liquid inlet valve 791 to mixing chamber 796. In one embodiment, liquid inlet valve 791 requires between about 2 and 5 psi to open. In some embodiments, during operation, air recharges air chamber 643 by flowing in through outlet nozzle 674, through foaming media 675 and through air passage 795. Recharging in this manner provides for "suck back" of residual foam or liquid that is downstream of liquid outlet valve 791 and prevents the pump from dipping or leaking between dispense cycles.

Exemplary embodiments of manufacturing foam pumps are also provided herein. The exemplary steps may be performed in any order. In addition, although the exemplary method disclosed below is for a foam pump, the method for manufacturing a liquid pump is substantially the same as described below without the need to manufacture the air components. An exemplary method of manufacturing foam pumps described herein include, for example, fabricating a pump housing that has a connector for connecting to a container, a liquid inlet, a cavity, an air inlet, and a fluid outlet. In addition, the method includes fabricating a sleeve having a liquid cylinder and an air cylinder. A liquid piston and an air piston are also fabricated as well as a lower housing and an insert. The foam pump is assembled by securing the liquid inlet valve to the housing, wherein the liquid inlet valve is located upstream of the liquid inlet. The insert is inserted into the fluid outlet, and retained there by securing the lower housing to the fluid outlet of the housing. The liquid piston is installed in the liquid cylinder and the air piston is installed in the air cylinder of the sleeve. The sleeve is inserted at least partially into the cavity and is secured to the pump housing.

In some embodiments, the insert contains a liquid outlet valve and a foaming media. In some embodiments, the insert contains a liquid outlet valve, an air inlet valve, a mixing chamber and a foaming media. In some embodiments, the insert contains a liquid outlet valve, an air inlet passage, a mixing chamber and a foaming media. In some embodiments, the liquid inlet valve is inserted within an annular projection. In some embodiments, the liquid inlet valve is inserted downward from the top of the pump housing.

The air compressors and liquid pumps described herein may include biasing members to return them to a charged or primed state. In some embodiments, a biasing member in the actuator mechanism returns the air compressor and/or liquid pump to a first state. Still yet, if the air compressor and/or liquid pump are electrically operated, they may be moved to the first state electronically.

In addition, in some embodiments, the pump housing is made from a first material that has a first set of properties and the sleeve is made from a second material that has a second set of properties, wherein some of the properties are different. For example, the housing may be made up of a more flexible material that is of a lower quality, and has a property that may sink or deform slightly, while the sleeve is made up of a sturdier material that is easier to mold without sinking or otherwise changing from the desired shape.

Figure 8:
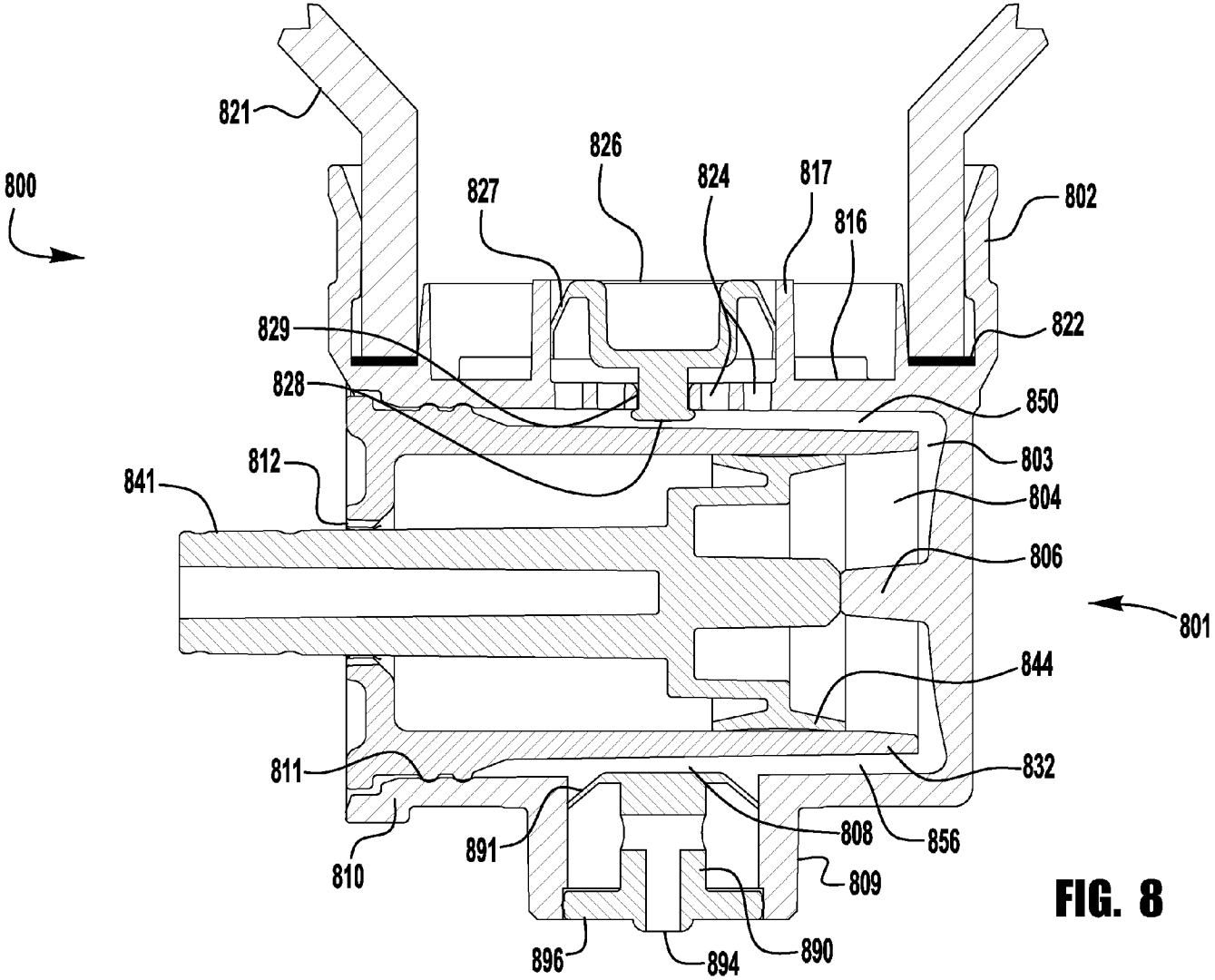
FIG. 8 is a cross-section of an exemplary liquid pump and refill unit 800.

FIG. 8 illustrate a cross-sectional view of another exemplary embodiment of a refill unit 800 suitable for use in dispensers. Refill unit 800 includes a container 821 for holding a liquid connected to a liquid pump 801. Liquid pump 801 is similar to foam pump 601 but does not include an air compressor portion. Liquid pump 801 includes a housing 802. Housing 802 may be connected to the container 821 by any means such as, for example, a threaded connection, a welded connection, an adhesive connection or the like. Optionally, a gasket 822 may fit in an annular groove to help form a liquid-tight seal with the container 821.

Housing 802 includes a top plate 816. Top plate 816 includes an annular inlet valve projection 817. Located within annular inlet valve projection 817 are a plurality of liquid inlet apertures 824 and an inlet valve retention aperture 829. An inlet valve 826 includes a seal 827 that engages annular projection 817 to form a one-way inlet valve. Inlet valve 826 also includes a stem 828 that extends through inlet aperture 829. Stem 828 includes an expanded base or bulb at the distal end that is squeezed through inlet aperture 829 and expands once it is within cavity 803 to anchor one-way inlet valve 826 in place.

Pump housing 802 includes a liquid chamber 804. In some embodiments liquid chamber 804 is cylindrical, in some embodiments, liquid chamber 804 is partially cylindrical. Located at least partially within liquid chamber 804 is a sleeve 832. Housing 802 includes an annular projection 810 at one end of the liquid chamber 804. Sleeve 832 is secured to annular projecting member 810 by collar 811, but may be connected using any known method. Collar 811 includes an aperture 812.

A piston 840 includes a shaft 841 that projects through aperture 812. Piston 840 is slideable in a reciprocating manner within sleeve 832. Piston 840 includes a piston head having a double wiper seal 844 located at the distal end. Movement of piston 840 causes the volume of liquid chamber 804 to expand and contract. Double wiper seal 844 may be any type of sealing member such as, for example, an o-ring, a single wiper seal or the like. Housing 802 includes a projecting member 806 that contacts an end of piston 840 to stop movement of piston 840 when it reaches the end of its stroke.

A liquid inlet passageway 850 is formed between sleeve 832 and the wall of liquid chamber 804. The inlet passageway 850 may extend entirely around sleeve 832 or may be enclosed by one or more rib projections (not shown) that cause liquid in inlet passageway 850 to flow through passage 850 and into the interior of sleeve 832. Outlet passage 856 also exists between sleeve 832 and liquid chamber 804. Outlet passageway 856 may extend entirely around sleeve 832 or may be enclosed by one or more rib projections (not shown) that cause liquid to flow through passageway 856 from the interior of sleeve 832.

Housing 802 includes a liquid outlet opening 808 formed at least in part by annular projection 809. Located within annular projection 809 is an insert 890. Insert 890 may be made of one or more components. Insert 890 includes a liquid inlet seal 891. In addition, insert 890 contains an outlet passage 894.

During operation, as piston 840 of pump 801 moves from a discharged position to a charged position or primed state, liquid flows in through liquid inlets 824, past one-way inlet valve 826 into liquid chamber 804 and through passage 850 and into the interior of sleeve 832 (which also forms a portion of the liquid chamber 804).

Movement of piston 840 from the charged position to the discharged position causes fluid to flow out of the liquid chamber 804 (including the center of the sleeve 832) through passage 856, past liquid outlet valve 891 and out through outlet 894.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept. In addition, various aspects of the exemplary embodiments may be combined with one another to form embodiments of the present invention that have not been expressly illustrated as combined with one another.

We claim:

1. A refill unit comprising:

a container for holding a foamable liquid;

a pump housing connected to the container;

the pump housing including a cavity, a liquid inlet passage and a liquid outlet passage;

the liquid inlet passage placing the container in fluid communication with the cavity;

the liquid outlet passage placing the cavity in fluid communication with a mixing chamber;

a liquid outlet valve located downstream of the liquid outlet passage and upstream of the mixing chamber;

a liquid inlet valve located between the container and the cavity;

a cylindrical sleeve located at least partially within the cavity;

a liquid piston reciprocally movable within the cylindrical sleeve;

the cylindrical sleeve forming at least a portion of a liquid pump chamber;

an air compressor;

an air passageway placing the air compressor in fluid communication with the mixing chamber;

an air inlet valve and wherein the liquid outlet valve and the air inlet valve are part of an insert; and an outlet nozzle in fluid communication with the mixing chamber for dispensing a mixture of foamable liquid and air.

2. The refill unit of claim 1 wherein the air compressor is cylindrical and is concentric with the cylindrical sleeve.

3. The refill unit of claim 1 wherein an opening of the liquid inlet passage into the cavity is concentric with the cylindrical sleeve.

4. The refill unit of claim 1 wherein an opening of the liquid outlet passage into the cavity is offset from the centerline of the cylindrical sleeve.

5. The refill unit of claim 1 wherein the liquid pump moves in a substantially horizontal motion.

6. The refill unit of claim 1 wherein the container comprises a neck, the pump housing is connected to the neck and the liquid inlet passage is offset from the center of the neck of the container.

7. The refill unit of claim 1 wherein the pump housing is made of a first material having a first set of physical properties and the cylindrical sleeve is made of a second material having a second set of physical properties.

8. The refill unit of claim 1 wherein the liquid inlet valve is a flexible membrane located at least partially within the cavity, the flexible membrane having one or more apertures therethrough;

wherein the flexible membrane acts as a one-way liquid inlet valve and at least a portion of the flexible membrane covers the liquid inlet passage and prevents liquid from flowing from the liquid pump chamber into the liquid inlet passage; and wherein when the liquid pump chamber is under negative pressure, the flexible membrane flexes to uncover the liquid inlet passage and allows liquid to flow through the liquid inlet passage through the one or more apertures in the flexible membrane and into the liquid pump chamber.

9. The refill unit of claim 8 wherein the cylindrical air compressor and cylindrical sleeve are a unitary piece and the liquid piston and an air piston of the air compressor are connected together.

10. A refill unit comprising:

a container for holding a foamable liquid;

a pump housing connected to the container;

the pump housing including a cavity, a liquid inlet passage and a liquid outlet passage;

the liquid inlet passage placing the container in fluid communication with the cavity;

a liquid inlet valve secured to the housing and located between the container and the liquid inlet passage to the cavity;

the liquid outlet passage placing the cavity in fluid communication with a mixing chamber;

a liquid outlet valve located downstream of the liquid outlet passage and upstream of the mixing chamber;

a cylindrical sleeve located at least partially within the cavity;

a liquid piston reciprocally movable within the cylindrical sleeve;

the cylindrical sleeve forming at least a portion of a liquid pump chamber;

an air compressor;

an air passageway placing the air compressor in fluid communication with the mixing chamber;

an air inlet valve and wherein the liquid outlet valve and the air inlet valve are part of an insert; and an outlet nozzle in fluid communication with the mixing chamber for dispensing a mixture of foamable liquid and air.

11. The refill unit of claim 10 further comprising an outlet nozzle, wherein the movement of the liquid piston is substantially normal to the direction of fluid flow out of the nozzle.

12. The refill unit of claim 10 wherein the insert further comprises a foaming media.

13. The refill unit of claim 10 wherein the liquid inlet valve opens at between about 2 and 5 psi.

14. The refill unit of claim 10 further comprising an air inlet valve and wherein the air inlet valve opens at between about 2 and 5 psi.

15. The refill unit of claim 10 wherein the liquid outlet valve is a wiper valve.

16. The refill unit of claim 15 wherein the insert further comprises a foaming media.

17. A refill unit comprising:

a container for holding a foamable liquid;

a pump housing connected to the container;

the pump housing including a cavity, a liquid inlet passage and a liquid outlet passage;

the liquid inlet passage placing the container in fluid communication with the cavity;

a liquid inlet valve secured to the housing and located between the container and the liquid inlet passage to the cavity;

the liquid outlet passage placing the cavity in fluid communication with a mixing chamber;

a liquid outlet valve located downstream of the liquid outlet passage and upstream of the mixing chamber;

a cylindrical sleeve located at least partially within the cavity;

a liquid piston reciprocally movable within the cylindrical sleeve;

the cylindrical sleeve forming at least a portion of a liquid pump chamber;

an air compressor;

an air passageway placing the air compressor in fluid communication with the mixing chamber;

an outlet nozzle in fluid communication with the mixing chamber for dispensing a mixture of foamable liquid and air; and an air inlet valve and wherein the liquid outlet valve and the air inlet valve are wiper seals and open in opposite directions.

* * * * *